US007661673B2

(12) United States Patent
Doyo

(10) Patent No.: US 7,661,673 B2
(45) Date of Patent: Feb. 16, 2010

(54) SHEET CONVEYING APPARATUS AND IMAGE FORMING APPARATUS WITH THE SHEET CONVEYING APPARATUS

(75) Inventor: Hideaki Doyo, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 12/098,505

(22) Filed: Apr. 7, 2008

(65) Prior Publication Data

US 2008/0251991 A1 Oct. 16, 2008

(30) Foreign Application Priority Data

Apr. 13, 2007 (JP) ..... 2007-105668

(51) Int. Cl.
*B65H 5/00* (2006.01)

(52) U.S. Cl. ..... 271/264; 271/272

(58) Field of Classification Search ..... 271/264, 271/184, 186
See application file for complete search history.

(56) References Cited

U.S. PATENT DOCUMENTS 6,293,541 B1 * 9/2001 Horiuchi et al. ..... 271/184
7,455,294 B2 * 11/2008 Lin et al. ..... 271/264
2005/0067773 A1 * 3/2005 Yoshida et al. ..... 271/264
2007/0152398 A1 * 7/2007 Watanabe ..... 271/264
2008/0296837 A1 * 12/2008 Jowett et al. ..... 271/264

FOREIGN PATENT DOCUMENTS

JP 06001514 A * 1/1994
JP 2000-95382 4/2000

* cited by examiner

*Primary Examiner*—Kaitlin S Joerger
(74) *Attorney, Agent, or Firm*—Gerald E. Hespos; Anthony J. Casella

(57) ABSTRACT

A sheet conveying apparatus includes: a sheet conveyance path designed so as to include nonlinear portions; a first conveyance roller pair which is provided at predetermined positions of the sheet conveyance path and which has a conveyance width capable of nipping and conveying a sheet having the minimum size sheet passing width among sheets to be passed through the sheet conveying apparatus; a guide plate which is placed in a downstream side or an upstream side of the first conveyance roller pair in a sheet conveyance direction and has a curved guide surface; and a plurality of guide ribs which are extended on the guide surface in the sheet conveyance direction and are provided in a sheet passing width direction of the sheet in a region corresponding to the conveyance width of the first conveyance roller pair.

9 Claims, 10 Drawing Sheets

SHEET CONVEYING APPARATUS AND IMAGE FORMING APPARATUS WITH THE SHEET CONVEYING APPARATUS

BACKGROUND OF THE INVENTION

1. Field of the Invention

The present invention relates to a sheet conveying apparatus for conveying sheets along a curved guide surface through a pair of conveyance rollers disposed at an upstream side and at a downstream side of the guide surface and an image forming apparatus with the sheet conveying apparatus.

2. Description of the Related Art

In an image forming apparatus such as a printer, a copying machine, a facsimile machine, or the like, a sheet before or after it is provided with an image is conveyed by a sheet conveyance apparatus. Various kinds of sheets are used as a sheet on which an image is provided. For example, art paper having high surface smoothness used in image formation such as a photograph and, to the contrary, recycled paper having low surface smoothness, or the like are used in addition to copying paper in general use. Also, each kind of paper includes different sizes from a larger size to a smaller size, or different thicknesses from a thicker one to a thinner one. Namely, various kinds of sheets in various conditions and sizes are used.

On the other hand, a sheet conveyance path through which a sheet is conveyed is provided with a guide plate for guiding the sheet to be conveyed. Generally, the guide plate is provided with projecting guide ribs extended to a sheet conveyance direction. Many guide ribs are provided almost throughout the width in a sheet passing width direction (a direction orthogonal to the sheet conveyance direction). For example, when an A4 size sheet is conveyed in a portrait orientation, the shorter side of the A4 size sheet is the sheet passing width and the guide ribs are provided almost throughout the sheet passing width, such that increase of conveyance resistance caused by direct contact of the sheet to be conveyed with the a guide plate can be prevented (e.g., Japanese Patent Application Laid-open Publication No. 2000-95382).

In the above-described sheet conveying apparatus, however, there has been a problem that friction between the guide ribs and the sheet to be carried would cause a conveyance friction noise. More specifically, a large conveyance friction noise used to occur when a pair of conveyance rollers is provided at an upstream side and at a downstream side in the sheet conveyance direction and guide ribs curved into a convex shape toward the sheet conveyance path are provided between the pair of conveyance rollers. That is, when the sheet is conveyed such that the trailing edge of the sheet is nipped by the pair of conveyance rollers at the upstream side and the leading edge of the sheet is nipped by the pair of conveyance rollers at the downstream side, the sheet is pulled because of the linear speed of both pairs of conveyance rollers or a drive control timing of both pairs of conveyance rollers and frictionally rubbed against the guide ribs curved into the convex shape with a strong force. Therefore, the conveyance friction noise tends to be louder. This tendency becomes more remarkable when a sheet having lower surface smoothness such as recycled paper is used.

Also, there may be such a case that a leading edge of some kinds of sheets, e.g., a curled sheet, a sheet having one side printed, a sheet having a cutting burr at its edge, and a thick rigid sheet, may cause a friction noise when it hits the guide ribs. In recent image forming apparatuses, many of them have a sheet conveyance path which curves with a small curvature in order to downsize the apparatus, such that a guide plate which is placed in such a sheet conveyance path tends to generate the friction noise. Further, depending on the angle of approach of the leading edge of the sheet to the guide plate, there are such inconveniences that the sheet may be buckled and the leading edge of the sheet may hit projecting side walls of the guide ribs, causing the sheet to skew.

SUMMARY OF THE INVENTION

An object of present invention is to provide a sheet conveying apparatus capable of lowering the conveyance friction noise upon conveying the sheet, and an image forming apparatus with such a sheet conveying apparatus.

A sheet conveying apparatus according to one aspect of the present invention which achieves this object comprises: a sheet conveyance path designed so as to include nonlinear portions; a first conveyance roller pair which is provided at predetermined positions of the sheet conveyance path and which has a conveyance width capable of nipping a sheet having the minimum size sheet passing width among sheets to be passed through the sheet conveying apparatus; a guide plate which is placed in a downstream side or an upstream side of the first conveyance roller pair in a sheet conveyance direction and has a curved guide surface; and a plurality of guide ribs which are extended on the guide surface in the sheet conveyance direction and are provided in a sheet passing width direction of the sheet in a region corresponding to the conveyance width of the first conveyance roller pair.

An image forming apparatus according to another aspect of the present invention comprises: an image forming unit configured to form an image on a sheet; and a sheet conveyance unit configured to convey the sheet having a predetermined sheet passing width through the image forming unit, the sheet conveyance unit having the configuration of the above sheet conveying apparatus.

DETAILED DESCRIPTION OF THE PREFERRED EMBODIMENTS

Figure 1:
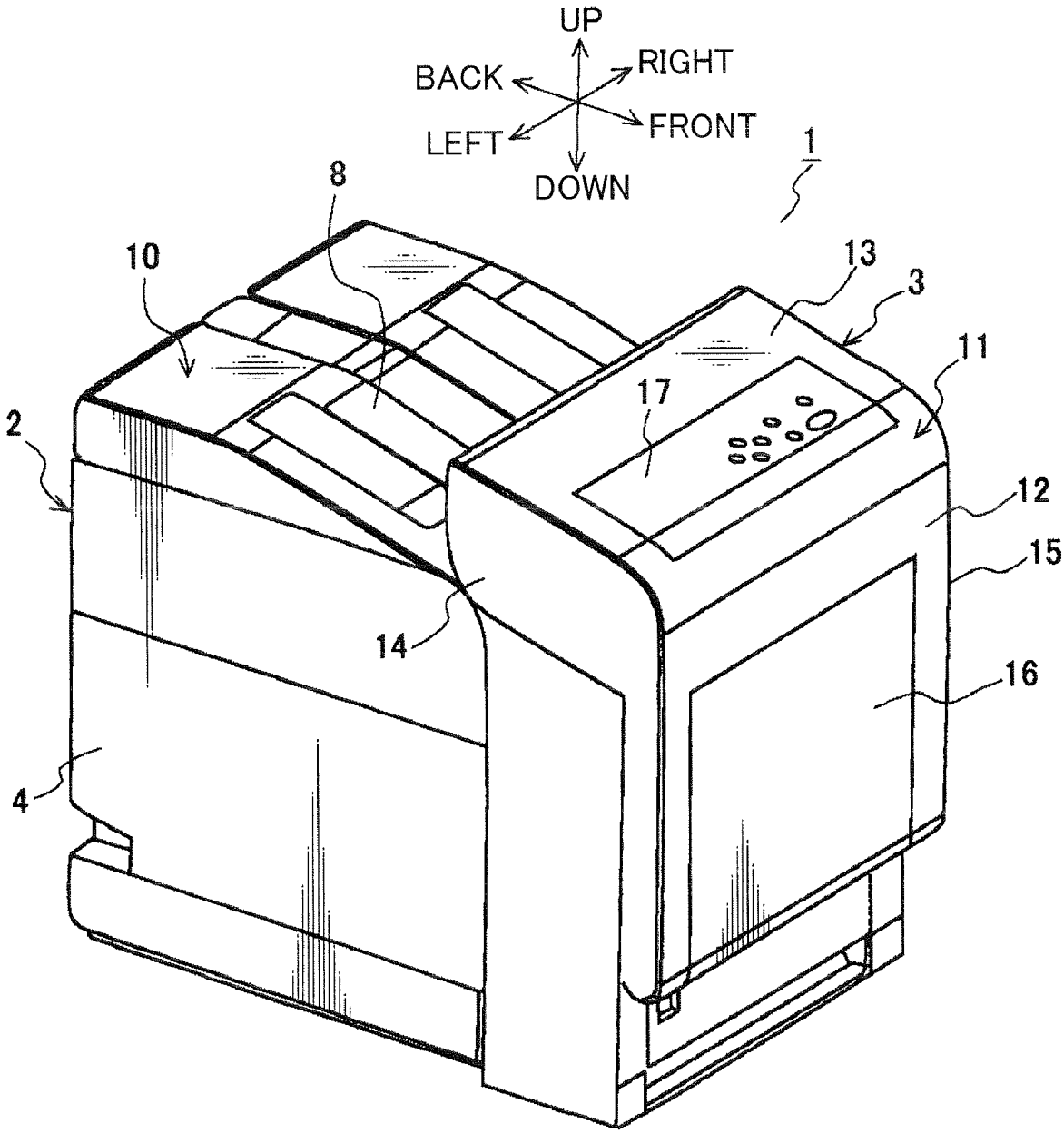
FIG. 1 is an entire perspective view of the image forming apparatus according to a first embodiment of the invention when it is viewed from a diagonally left upward direction on the front side of the apparatus.

Now, preferred embodiments for carrying out the invention will be described with reference to the accompanying drawings. In the drawings, components having the same reference numerals have the same configurations, and therefore, redundant descriptions thereof will be omitted here. In the drawings, descriptions of members of which explanations are not essential will also be omitted.

FIRST EMBODIMENT

Figure 2:
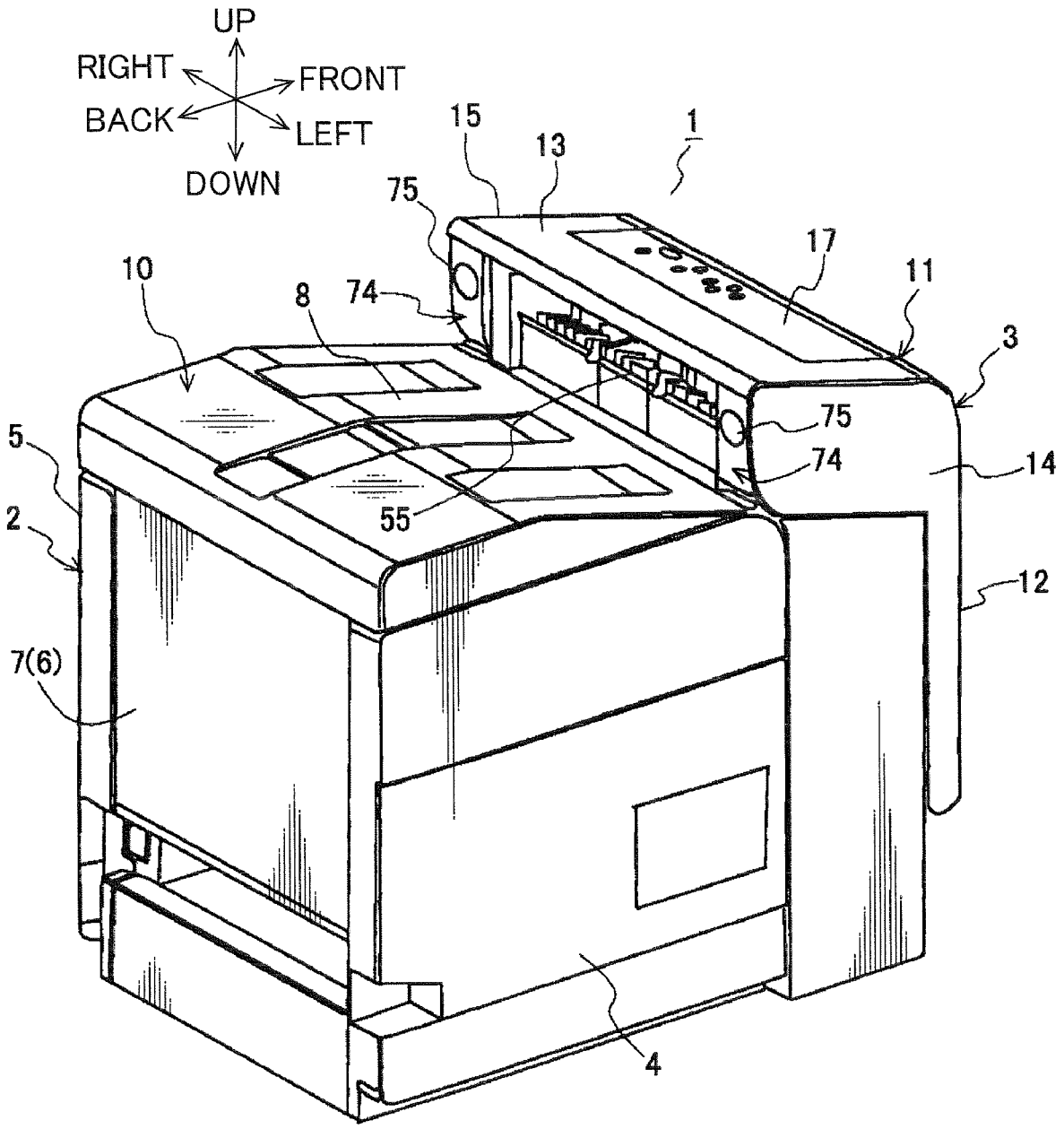
FIG. 2 is an entire perspective view of the image forming apparatus when it is viewed from a diagonally backward upward direction on the left side.
Figure 3:
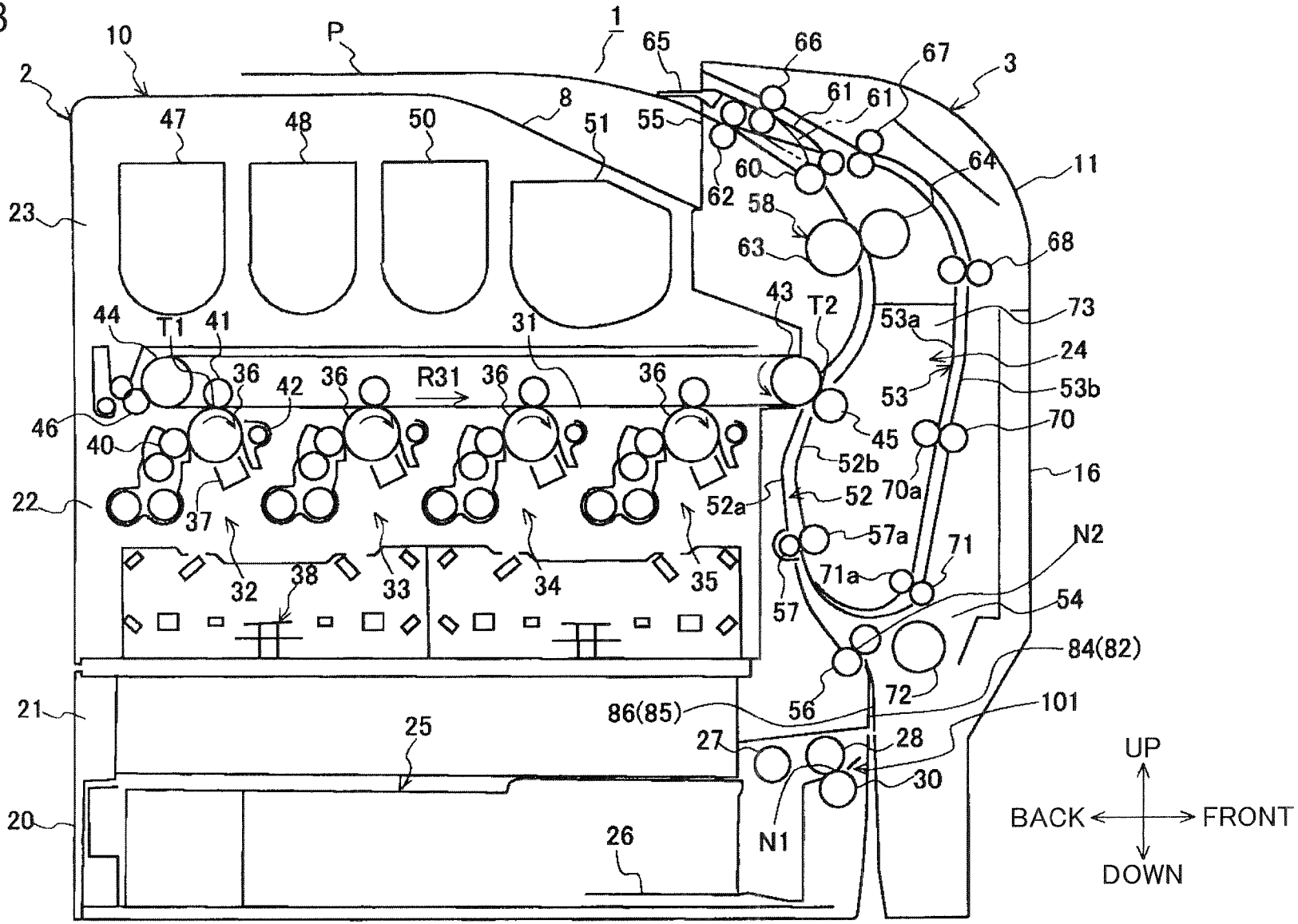
FIG. 3 is a cross sectional view schematically illustrating a configuration of an inside of the image forming apparatus.

An image forming apparatus 1 with a sheet conveying apparatus 100 according to a first embodiment will be described below with reference to FIGS. 1 to 3. In FIGS. 1 to 3, arrows show directions of up, down, front, back, left, and right of the image forming apparatus 1. FIG. 1 is a perspective view of the entire image forming apparatus when it is viewed from a diagonally left upward direction on the front side of the apparatus; FIG. 2 is a perspective view of the entire image forming apparatus when it is viewed from a diagonally backward upward direction on the left side of the apparatus; and FIG. 3 illustrates an inside configuration of the image forming apparatus 1 when it is viewed from the left side.

Examples of the image forming apparatus 1 include a printer, a copying machine, a facsimile machine, and a multifunction device including those functions together; however, a case where the image forming apparatus 1 is a printer will be exemplified in the following description. The image forming apparatus 1 of FIGS. 1 to 3 is a full-color image forming apparatus 1 of four colors employing an electrophotographic method, an intermediate transfer method, or a tandem method.

Now, a configuration of the entire image forming apparatus 1 will be described viewing from the outside of the apparatus with reference to FIGS. 1 and 2. The image forming apparatus 1 includes an almost box-shaped (cuboid) image forming apparatus main body 2 and a front cover 3 supported by the apparatus main body 2 in an open/close free manner.

In the apparatus main body 2, a front thereof is covered by the front cover 3, and a left side and a right side are covered by a resin-made left exterior panel 4 and a resin-made right exterior panel 5 respectively. A portion 7 of the plate, which partially forms the main body frame 6 into a structural object, is exposed at a back surface of the apparatus main body 2. A front section of a top surface of the apparatus main body 2 is covered by a front cover 3, and from a middle section to a rear section is covered by a discharge tray 10 having a sheet loading surface 8 which inclines toward the back.

The front cover 3 includes a front exterior panel 11 and a portion of a below-described sheet conveyance unit 24 (see FIG. 3) which is assembled inside the front exterior panel 11. The front exterior panel 11 includes integrally with a front panel 12, an inclining top panel 13 continuously extending from a top edge of the front panel 12, and a left panel 14 and a right panel 15 having reverse-L shapes.

The front panel 12 is provided with a rectangular manual feeding tray 16. The manual feeding tray 16 has its pivot shaft at its lower end side. When the front panel 12 is in a closed position, i.e., a standing position as illustrated in FIG. 1, it becomes a part of the front panel 12 and when it is in an open position (not shown), i.e., a position the upper end side is pulled forward, the front panel 12 serves as a feeding tray where a sheet is placed on its top surface.

The top panel 13 is provided with an operation panel 17 for receiving an input of operation information. The operation panel 17 is placed such that a rear end side of the operation panel 17 becomes slightly higher than the front end side to place it facing upward so as to provide the operator (for example, a user) who stands on a front side of the image forming apparatus 1 an easy view. The operation panel 17 is provided with a touch-panel type liquid crystal display unit and various kinds of buttons. The operator can give various operation information to the image forming apparatus 1 through the operation panel 17 while he/she is standing in front of the image forming apparatus 1. The left panel 14 and the right panel 15 are designed to cover portions of the sheet conveyance unit 24 inside the front cover 3 from the left side and the right side, respectively.

The front cover 3 is supported at its lower end side by an apparatus main body 2 in a movable manner and, when it is in an open position, the front cover in its entirety is openable/closable such that the upper end side of the front cover 3 moves away from the apparatus main body 2. Lock canceling levers 74 which are operated upon opening the front cover 3 are disposed on an inside (right side) of an upper end side and a rear end side of the left 14 panel and on an inside (left side) of an upper end side and a rear end side of the right panel 15.

The lock canceling levers 74 have supports at their lower end sides and, when buttons 75 disposed on upper ends thereof are pushed toward the user to release lock members (not-shown) which are supported by the front cover 3 and which are engaged in a side of the image forming apparatus main body 2, resulting in allowing the front cover 3 to open. The front cover 3 having the above-described configuration makes it possible for the user to handle a jamming, i.e., to remove a jammed sheet, such that the user pulls the front cover 3 toward the user from a front side of the image forming apparatus 1. Further, a sheet cassette 25 (see FIG. 3) accommodating sheets on which images are formed is detachable from the front side similar to the front cover. As described above, the operator can carry out all the operations of the image forming apparatus 1 through the operation panel 17, such as jamming handling when a jamming occurs, sheet feeding to the sheet cassette 25 when the sheets run out, and the like, from the front side of the image forming apparatus 1.

Now, an interior configuration of the image forming apparatus 1 will be described below with reference to FIG. 3. The image forming apparatus 1 includes a sheet accommodating unit 20, a substrate housing unit 21, an image forming unit 22, a toner supply unit 23, and a sheet discharge tray 10 in this order from a bottom to a top of the image forming apparatus main body 2. Also, a sheet conveyance unit 24 is provided between the front side of the image forming apparatus main body 2 and the front cover 3.

The sheet accommodating unit 20 is provided with a sheet cassette 25. The sheet cassette 25 accommodates a plurality of sheets stacked therein and a leading edge side of the stacked sheets (right side of FIG. 3) upwardly by a lift plate 26 disposed on a bottom of the image forming apparatus main body 2. With such a configuration, a top sheet in the sheet cassette 25 is conveyed by a pickup roller 27 of a sheet conveyance unit 24, which will be described later, while a delivery roller 28 and a retard roller 30 prevents the sheet from double feeding to thereby feed only one sheet to a downstream side. The sheet cassette 25 can be inserted or ejected from the front side of the image forming apparatus 1. The substrate housing unit 21 is placed above the sheet cassette 25.

The substrate housing unit 21 is provided with substrates, electric components, and the like (not shown) for controlling the entire image forming apparatus 1. An image forming unit 22 is placed above the substrate housing unit 21.

The image forming unit 22 includes an intermediate transfer belt 31 and four (four-color) image forming stations having similar configurations to each other in a rotation direction of the intermediate transfer belt 31 (an arrow direction R31), namely, a yellow (Y) image forming station 32, a magenta (M) image forming station 33, a cyan (c) image forming station 34, and a black (Bk) image forming station 35.

The yellow image forming station 32 includes a photosensitive drum 36, and a charging device 37, an exposure device 38, a development device 40, a primary transfer roller 41, a drum cleaner 42, and the like around the photosensitive drum 36 in a rotation direction (the arrow direction) of the photosensitive drum 36. The photosensitive drum 36 is driven rotationally in the arrow direction at a predetermined process speed. After a surface (an outer circumference surface) of the photosensitive drum 36 is charged uniformly with a predetermined polarity and potential by the charging device 37, a charge of an exposed portion is removed by the exposure device 38 based on image information received from a personal computer (not shown) or the like to form an electrostatic latent image. The electrostatic latent image is developed into a toner image in such a manner that toner contained in a developer is adhered to the electrostatic latent image by the development device 40. In the present embodiment, a two-component developer mainly including a toner and a carrier is employed.

A toner image formed on a surface of the photosensitive drum 36 is transferred onto the intermediate transfer belt 31. The intermediate transfer belt 31 is bridged between a driving roller 43 and a driven roller 44 to be rotated in the arrow direction R31 following a rotation in the arrow direction of the driving roller 43. A yellow toner image formed on the photosensitive drum 36 is primarily transferred onto the intermediate transfer belt 31 by a primary transfer roller 41 in a primary transfer unit T1. A residual toner on the surface of the photosensitive drum 36 after the primary transfer of the toner image (residual toner after the primary transfer) will be removed by a drum cleaner 42.

The other image forming stations 33, 34, 35 of the three colors (cyan, magenta, black) have similar configurations as the above-described yellow image forming station 32. Surfaces of the photosensitive drums 36 of the image forming stations 33, 34, 35 are also formed with toner images of the colors of cyan, magenta, and black, respectively, which are primarily transferred onto the intermediate transfer belt 31 in this order. As such, the toner images of four colors are superimposed on one another on the intermediate transfer belt 31. The toner images of four colors on the intermediate transfer belt 31 are secondary transferred onto a sheet to be conveyed by a below-described sheet conveyance unit 24 by a secondary transfer roller 45 at once in a secondary transfer unit T2. The residual toner on the surface of the intermediate transfer belt 31 after the secondary transfer of the toner (residual toner after the secondary transfer) will be removed by a belt cleaner 46 placed near the driven roller 44. A toner supply unit 23 is provided above the image forming unit 22.

The toner supply unit 23 includes four toner containers containing the respective color toners, i.e., a yellow toner container 47, a magenta toner container 48, a cyan toner container 50, and a black toner container 51. A development device 40 for each of the above-described toners is provided with a density sensor (not shown) for detecting a density of the toner (weight ratio of toner/developer). When the density sensor detects that an amount of toner within the development device 40 becomes less than a predetermined amount, toners of each color are supplied to the development device 40 from the toner containers 47, 48, 50, 51 of the corresponding colors. A sheet discharge tray 10 is placed above the toner supply unit 23.

The discharge tray 10 is formed so as to cover a top surface of the image forming apparatus main body 2. A middle section of the discharge tray 10 in a front and back direction of the apparatus main body 2 is inclined such that a rear end side of the sheet discharge tray becomes higher and the rear end side is formed flat so as to be continuous with the middle section. A sheet loading surface 8 of a top surface of the sheet discharge tray 10 receives sheets discharged from a sheet discharge opening 55 of a sheet conveyance unit 24, which will be described later, in a stacked manner on the top surface of the sheet discharge tray 10.

The sheet conveyance unit 24 is provided between a front side of the apparatus main body 2 and the front cover 3 in the present embodiment. The sheet conveyance unit 24 includes a sheet conveyance path 52 for guiding a sheet from bottom up, a sheet reconveyance path 53 which is placed at a front side of the sheet conveyance path 52 and guides the sheet from top down, and a manual feeder 54. In the present embodiment, the sheet reconveyance path 53 is a sheet conveyance path which is directly opened by opening the front cover 3. Also, the sheet conveyance path 52 is a sheet conveyance path which is indirectly opened through the below-described conveyance unit 73 by opening the front cover 3.

The sheet conveyance path 52 orients upwardly from a position near the above-described delivery roller 28; extends upwardly while it is slightly curved to form a convex shape projecting to the back side; and further extends upwardly turning around to a front side at a position near the intermediate transfer belt 31; still further extends upwardly oriented to the back side; and finally reaches the sheet discharge opening 55. The sheet conveyance path 52 includes a rear side guide 52*a* and a front side guide 52*b* which are opposed to each other, and a portion of the front side guide 52*b* is formed into a below-described conveying unit 73.

The sheet conveyance path 52 comprises a pickup roller 27, a pair of rollers including a delivery roller 28 and a retard roller 30 (second conveyance roller pair), a pair of conveyance rollers 56 (first conveyance roller pair), a pair of resist rollers 57, a secondary transfer roller 45 which sandwiches the intermediate transfer belt 31 together with the driving roller 43, a pair of fixing rollers 58, a pair of conveyance rollers 60, a switching flapper 61, a pair of paper discharge rollers 62, and the like, in this order from bottom to top. The pair of fixing rollers 58 includes a fixing roller 63 including therein a heater (not shown) and a pressure roller 64 which is brought into contact with the fixing roller 63 to form a fixing nip portion therebetween.

The sheet fed from the sheet cassette 25 through a pickup roller 27 and a pair of rollers including a delivery roller 28 and a retard roller 30 will be conveyed to the secondary transfer unit T2 by the pair of conveyance rollers 56 and the pair of resist rollers 57. Then, toner images of four colors on the intermediate transfer belt 31 are transferred onto the sheet in the secondary transfer unit T2 at one time and the toner images are fixed onto a surface of the sheet by being heated and pressurized while the sheet passes through the fixing nip portion.

The sheet after the toner images are fixed is conveyed to the pair of sheet discharge rollers 62 while it is guided through the pair of conveyance rollers 60 by a bottom surface of the switching flapper 61, and is discharged backwardly from the sheet discharge opening 55 facing to the back side to be stacked on the sheet loading surface 8 of the sheet discharge tray 10. In FIG. 3, a sensor flag 65 of the sheet discharge sensor disposed immediately at a downstream side of the pair of sheet discharge rollers 62 is in operation by a sheet P while it is discharged.

The sheet reconveyance path 53 extends at a slant toward the front side from slightly above the sheet discharge opening 55, further extends steeply toward the back side while it is slightly curved, and joins together with the sheet conveyance path 52 while it curves downwardly in a lower end portion to form a projecting shape. The sheet reconveyance path 53 includes a rear side guide 53*a* and a front side guide 53*b* which are opposed to each other. A portion of the rear side guide 53*a* is formed into a conveying unit 73. Also, almost the entirety of the front side guide 53*b* is incorporated into an interior side (back end side) of the exterior panel 11 to form the front cover 3 together with the exterior panel 11. The sheet reconveyance path 53 includes a pair of reversing rollers 66, a switching flapper 61, first, second, third, and fourth reconveyance roller pairs 67, 68, 70, 71 in this order from a top where is the upstream side when the sheet is reconveyed.

In the case where the image is formed on both sides of the sheet, the switching flapper 61 is switched to a position indicated by an alternate long and two short dashes line. The sheet of which surface is provided with a fixed toner image is conveyed to the pair of conveyance rollers 60, further conveyed along the top surface of the switching flapper 61, and still further conveyed backwardly by the pair of reversing rollers 66. Subsequently, the pair of reversing rollers 66 is inversely rotated after the trailing edge of the sheet passes through the pair of conveyance rollers 60 but before passing through the pair of reversing rollers 66, the sheet is conveyed downwardly by first, second, third, and fourth pairs of reconveyance rollers 67, 68, 70, 71, and further conveyed to the sheet conveyance path 52. Accordingly, a back side of the sheet is provided with a toner image transferred and fixed thereon in a similar manner as it was done for the front surface of the sheet, and thereafter the sheet is discharged backwardly from the sheet discharge opening 55 to be stacked on the sheet loading surface 8 of the sheet discharge tray 10.

At an immediate front side of the pair of conveyance rollers 56 of the sheet conveyance unit 24, a manual delivery roller 72 is disposed. Also, the front cover 3 is provided with a manual feeding tray 16 in an open free manner. The manual feeding tray 16 forms a part of the front cover 3 when it is closed, and it is pulled out when sheets are manually supplied to set the sheets on the manual feeding tray 16 to be supplied to a side of the pair of conveyance rollers 56.

The sheet conveyance unit 24 includes the conveying unit 73 which is partially openable. The conveying unit 73 is disposed between the sheet conveyance path 52 and the sheet recoveyance path 53. The conveying unit 73 includes a portion of the front side guide 52*b* of the sheet conveyance path 52, a portion of the rear side guide 53*a* of the sheet reconveyance path 53, and one of the rollers 57*a* of the pair of resist rollers 57, a secondary transfer roller 45, one of the rollers 70*a*, 71*a* of each of the third and the fourth pairs of reconveyance rollers 70, 71, which are formed into one piece. The conveying unit 73 is supported by the apparatus main body 2 in an open free manner with a center of movement at a lower end side thereof. When the front cover 3 is opened, the upper end side of the conveying unit 73 is also opened forwardly and a portion of the sheet conveyance path 52 and a portion of the sheet reconveyance path 53 are opened.

Figure 4:
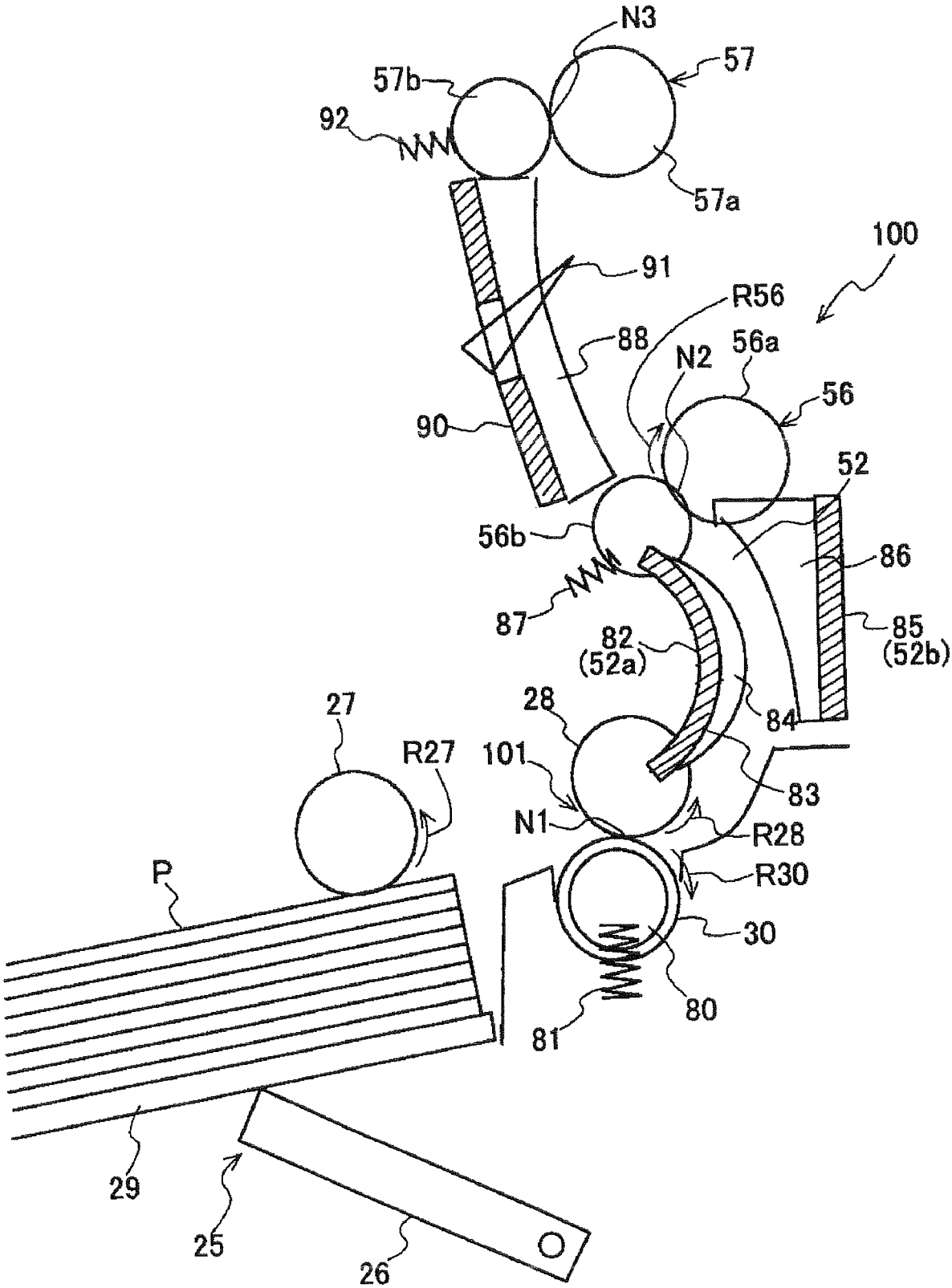
FIG. 4 is an enlarged illustration of a configuration of a sheet conveyance path from a sheet cassette to a pair of resist rollers according to the first embodiment.
Figure 5:
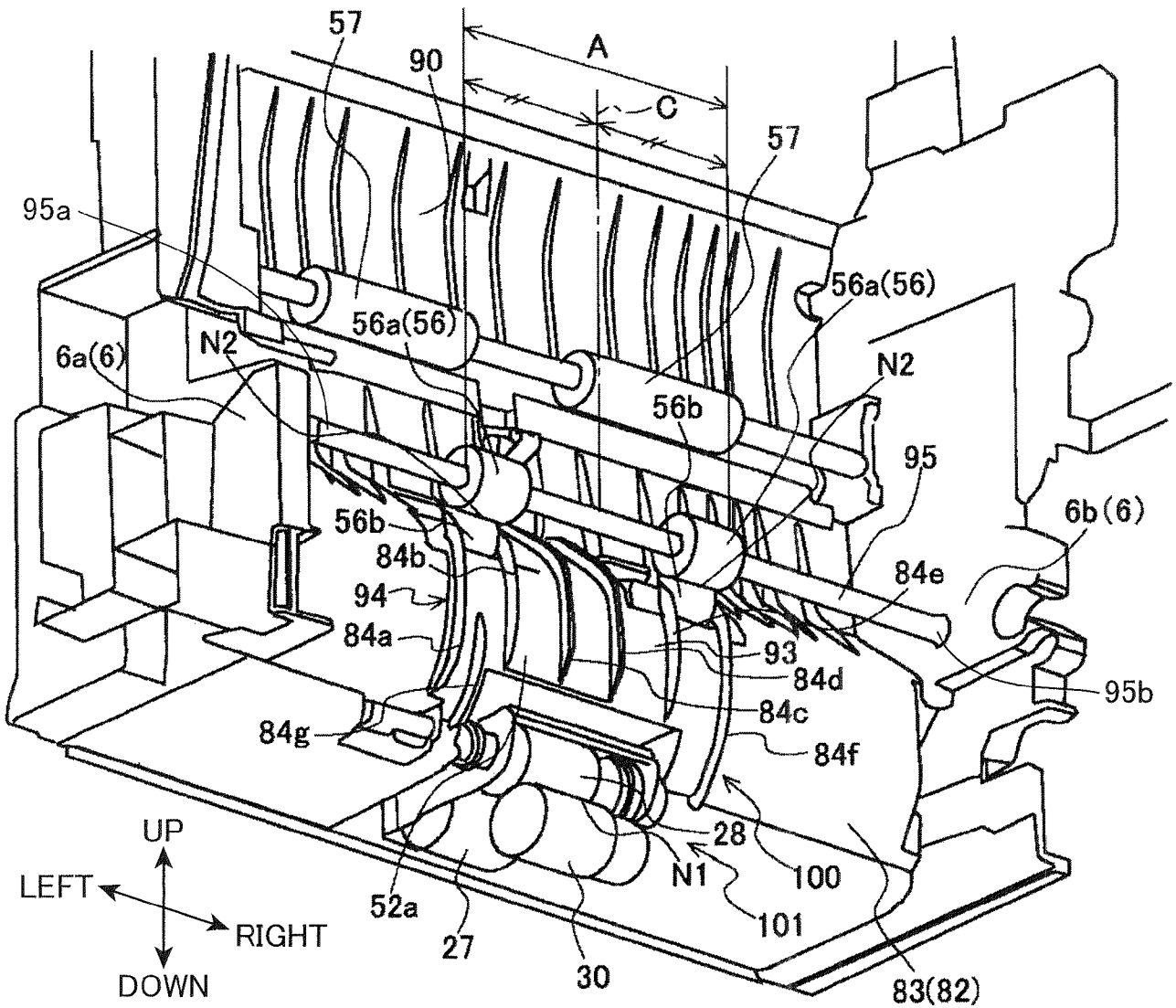
FIG. 5 is a perspective view illustrating around a guide plate exposed by opening the sheet conveyance path.
Figure 6:
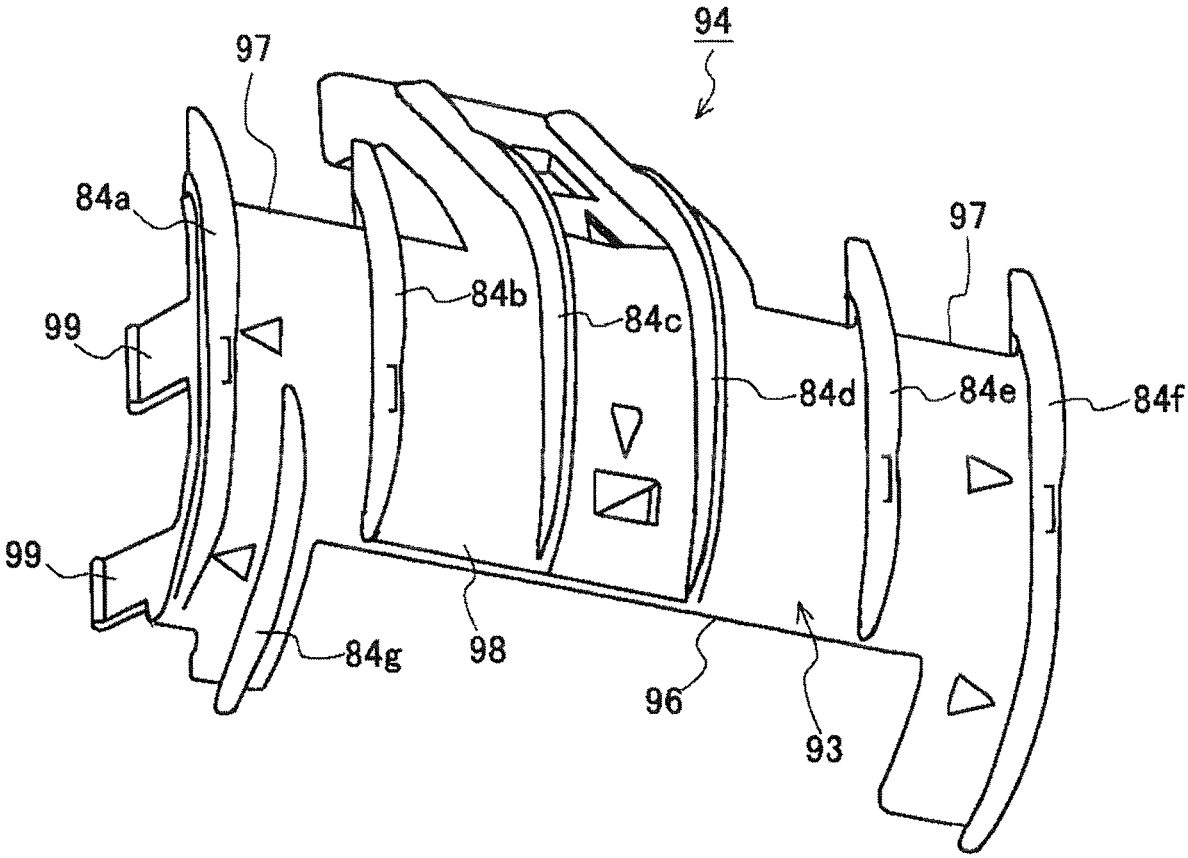
FIG. 6 is a perspective view illustrating a guide rib unit according to the first embodiment.
Figure 7:
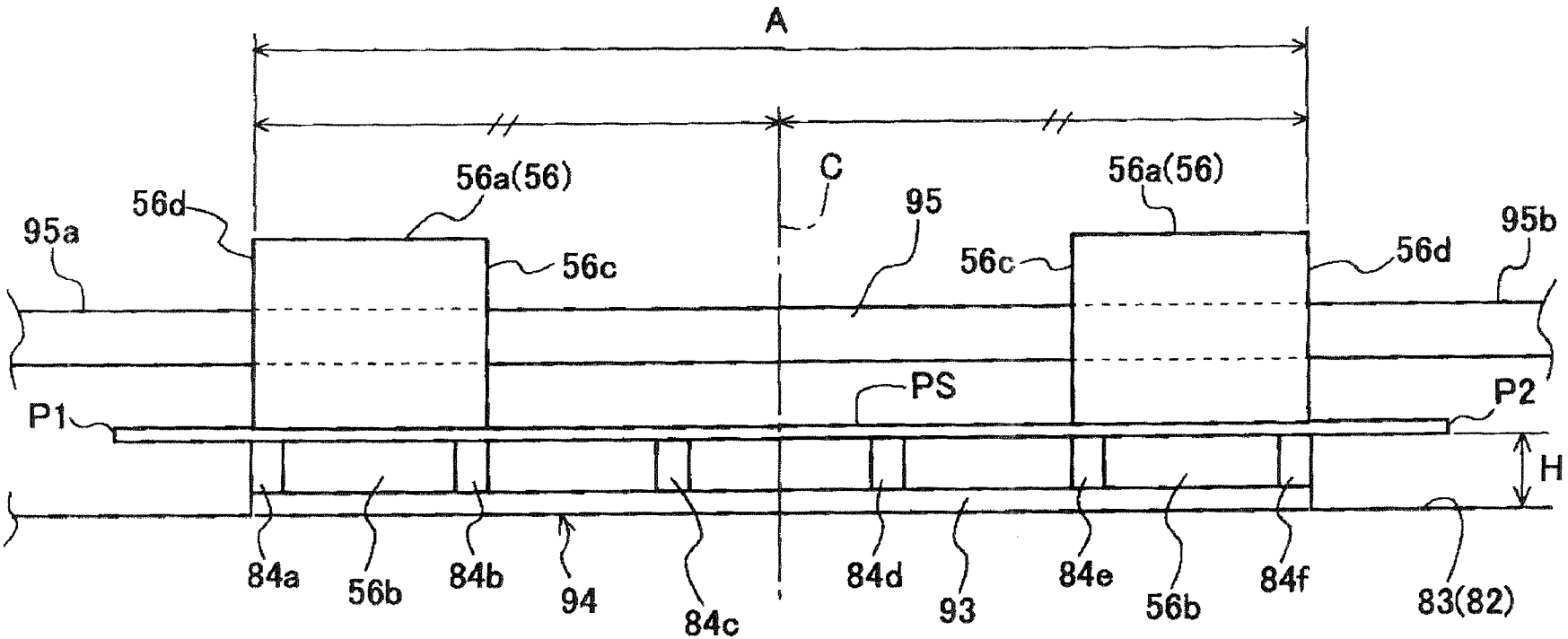
FIG. 7 illustrates a length relation between the pair of conveyance rollers, the guide plate, and the sheet having the minimum sheet passing width in a sheet passing width direction thereof.

Now, a sheet conveying apparatus 100 will be described with reference to FIGS. 4, 5, 6, and 7. FIG. 4 illustrates an enlarged configuration of the sheet conveyance path 52 from the sheet cassette 25 to the pair of resist rollers 57 of FIG. 3. FIG. 5 is a perspective view illustrating an exposed vicinity of the below-described guide plate 82 with the sheet conveyance path 52 being opened. FIG. 6 is a perspective view illustrating a guide rib unit 94 including a base plate 93 and a plurality of guide ribs 84 (84*a*-84*f*) which project from the base plate 93. FIG. 7 illustrates a relation of a length in a sheet passing width direction between the pair of conveyance rollers 56, the guide plate 82, and a sheet PS having the minimum sheet passing width (a sheet width orthogonal to the sheet conveyance direction).

The sheet conveying apparatus 100 includes the delivery roller 28 and the retard roller 30 as the second conveyance roller pair, the pair of conveyance rollers 56 as the first conveyance roller pair provided at the downstream side of the second conveyance roller pair, and the guide plate 82 placed between these pairs of rollers. The guide plate 82 has a guide surface 83 curved into a convex shape and a plurality of guide ribs 84 extending in the sheet conveyance direction in an area corresponding to an effective conveyance width of the pair of conveyance rollers 56 of the guide surface 83.

A sheet P to be supplied to the delivery roller 28 and the retard roller 30 is stacked in the sheet cassette 25 on a bottom plate 29 in a manner stacked thereon. The bundle of sheets P is pressed upwardly at its bottom plate 29 by the lift plate 26. The sheet P placed at a top of the bundle of sheets is brought into contact with the pickup roller 27 and is supplied to a separation nip portion N1 between the delivery roller 28 and the retard roller 30 by a rotation of the pickup roller 27 in an arrow direction R27.

The retard roller 30 is provided with a torque limiter 80 and is brought into contact with a surface of the delivery roller 28 by a separation spring (compression spring) 81 to form a separation nip portion N1. The retard roller 30 rotates in an arrow direction R30 following the sheet P conveyed through the separation nip portion N1 by a rotation in an arrow R28 direction of the delivery roller 28 when only one sheet P is supplied from the pickup roller 27 to the separation nip portion N1 owing to an effect of the torque limiter 80. On the other hand, when more than 2 sheets P are supplied to the separation nip portion N1, the retard roller 30 stop its rotation so as to not to allow the second or later sheet to pass through the separation nip portion N1.

The sheet conveyance path 52 between the delivery roller 28 and the retard roller 30 (hereinafter referred to as "a pair of conveyance rollers 101) and the pair of conveyance rollers 56 at a downstream side of the pair of conveyance rollers 101 in the sheet conveyance direction is formed into a conveyance path which is curved into a U-shape. In order to form an inner side wall of the U-shaped conveyance path, a guide plate 82 is provided between the pair of conveyance rollers 101 and the pair of conveyance rollers 56. The guide plate 82 forms a portion of the rear side guide 52*a* of the sheet conveyance path 52 as illustrated in FIG. 3 and has a guide surface 83 which projects and curves toward the sheet conveyance path 52.

As shown in FIG. 4, the guide ribs 84 (the below-described guide ribs 84*a* to 84*g*) are provided on the guide surface 83 in a projecting manner. The guide ribs 84 are extended in the sheet conveyance direction in a manner that the guide ribs 84 project and curve toward the sheet conveyance path 52 in the sheet conveyance direction similar to the guide plate 82. Also, the plurality of guide ribs 84 are provided in the sheet passing width direction of the sheet P as will be described later. Descriptions of the guide plate 82 and the guide ribs 84 will be given later in detail.

A second guide plate 85 which forms an outer side wall of the U-shaped conveyance path is provided opposite to the guide plate 82. A second guide plate 85 is provided with a plurality of guide ribs 86, which are curved into concave shapes toward the sheet conveyance path 52, in the sheet passing width direction.

The pair of conveyance rollers 56 are disposed at an immediately downstream side of the conveyance path formed by a pair of guide plates 82, 85 and include a driving roller 56*a* driven in a rotational manner in an arrow R56 direction and a driven roller 56*b* brought into contact with the driving roller 56*a* via a compression spring 87 to thereby rotate following the driving roller 56*a*. A conveyance nip portion N2 is provided between the driving roller 56*a* and the driven roller 56*b*.

A third guide plate 90 including a plurality of projecting guide ribs 88 is provided between the pair of conveyance rollers 56 and the pair of resist rollers 57 at the downstream side of the pair of conveyance rollers 56. The guide ribs 88 form a concave guide surface which curves toward the sheet conveyance path 52. A third guide plate 90 is provided with a detection sensor 91 for detecting that the sheet P having been conveyed reaches the pair of resist rollers 57.

The pair of resist rollers 57 includes a driving roller 57*a* and a driven roller 57*b* which is brought into contact with the driving roller 57*a* by being pressurized by a compression spring 92. A conveyance nip portion N3 is formed between the driving roller 57*a* and the driven roller 57*b*.

In the above-described configuration, the sheets P supplied from the sheet cassette 25 by the pickup roller 27 are separated by the pair of conveyance rollers 101 into one sheet, guided by the guide ribs 84 of the guide plate 82 and the guide ribs 86 of the second guide plate 85, and reach the pair of conveyance rollers 56. Then, the sheet P is guided by the guide ribs 88 of the third guide plate 90 through the pair of conveyance rollers 56, and thereby the leading edge of the sheet P comes to hit the nip portion N3 of the pair of resist rollers 57 in a halt condition. Thereby, a sheet P is corrected from its diagonal passing.

The sheet P, then, is conveyed to the secondary transfer nip portion T2 by the pair of resist rollers 57 at a right timing that the toner image formed on the intermediate transfer belt 31 of FIG. 3 reaches the secondary transfer nip portion T2 in association with a rotation of the intermediate transfer belt 31 in the arrow R31 direction. The sheet P conveyed to the secondary transfer nip portion T2 receives the toner image through the secondary transfer process as described above, and discharged to the sheet discharge tray 10 after the toner image is fixed onto the sheet P.

Here, the sheet P is nipped at its trailing edge by the separation nip portion N1 when the sheet P is conveyed between the pair of conveyance rollers 101 and the pair of conveyance rollers 56, and is further pulled and conveyed by the conveyance nip portion N2 of the pair of conveyance rollers 56 while the sheet P is nipped at its leading edge by the pair of conveyance rollers 56. Here, one side surface of the sheet P is rubbed against the guide ribs 84 of the guide plate 82, which is curved into the convex shape, to cause a conveyance friction noise. This friction noise occurs because the sheet P, while it is pulled between the upstream side separation nip portion N1 and the downstream side conveyance nip portion N2, is conveyed and thus rubbed against the guide ribs 84, such that the friction noise may be a relatively large noise. In the present embodiment, the conveyance friction noise is reduced in a manner as described below.

The pair of conveyance rollers 56 include the driving roller 56*a* (first roller) and the driven roller 56*b* (second roller); however, in this embodiment, there are two pairs of rollers which are placed in the sheet passing width direction with a predetermined interval therebetween. The two driving rollers 56*a* are integrally secured to a roller shaft 95 to form a roller body in which the driving rollers 56*a* rotate around the roller shaft 95.

The roller shaft 95 is supported at its left end portion 95*a* (one end portion) and right end portion 95*b* (the other end portion) in the shaft direction by a left side plate 6*a* and a right side plate 6*b* of a main body frame 6 in a rotation free manner. The roller shaft 95 receives a driving force from a driving source (not shown) at a side of the apparatus main body 2 through gears (not shown) to be driven rotationally around the shaft. The two driving rollers 56*a* are placed such that they are divided to the right and left in the center portion C of the roller shaft 95 in the sheet passing width direction along the roller shaft 95. In the present embodiment, the driving rollers 56*a* are placed so as to contact with the sheet PS having the minimum sheet passing width when the driving rollers 56*a* convey the sheet PS having the minimum sheet passing width (see FIG. 7).

Now, a positional relation between the driving rollers 56*a*, the sheet PS having the minimum sheet passing width, and the guide ribs 84 (84*a* to 84*g*) in the sheet passing width direction will be described below with reference to FIG. 7. With regard to the driven rollers 56*b* brought into contact with the driving roller 56*a*, a size in the sheet passing width direction thereof is set to be the same width as the driving rollers 56*a* or a shorter width than the driving rollers 56*a* and a position of the pair of conveyance rollers 56 in the sheet passing width direction is identical to that of the driving rollers 56*a*. Assuming that each of the interior side end surfaces of the two driving rollers 56*a* is referred to as an interior end surface 56C and each of the exterior side end surfaces of the two driving rollers 56*a* is referred to as an exterior end surface 56*d*, a fact that the sheet PS having the minimum sheet passing width contacts the driving rollers 56*a* means that a left end P1 of the sheet PS is positioned outside of the inner end surface 56*c* of the left side driving roller 56*a* (side of the left end portion 95*a* of the roller shaft 95) as well as means that a right end P2 of the sheet PS is positioned outside of the inner end surface 56*c* of the right side driving roller 56*a* (side of the right end portion 95*b* of the roller shaft 95).

There are such cases that the left end P1 of the sheet PS is positioned outside the exterior end face 56*d* of the left driving roller 56*a* as well as that the right end P2 of the sheet PS is positioned further outside of the exterior end surface 56*d* of the right driving roller 56*a*. In this case, it is so designed that there is no driving roller which contacts the sheet PS having the minimum sheet passing width outside the respective driving rollers 56*a*. In other words, the left driving roller 56*a* is the most leftward side driving roller 56*a* which contacts the sheet PS when the sheet PS having the minimum sheet passing width is conveyed, and the right driving roller 56*a* is the most rightward side driving roller 56*a* which contacts the sheet PS when the sheet PS having the minimum sheet passing width is conveyed.

In the driving rollers 56*a*, a distance between the exterior end surface 56*d* of the left driving roller 56*a* (portion nearest to the left end portion 95*a* of the roller shaft 95) and the exterior end surface 56*d* of the right driving roller 56*a* (portion nearest to the right end portion 95*a* of the roller shaft 95) is decided to be an effective conveyance width A. When it is so decided, an area including the guide ribs 84 (84*a* to 84*f*) is to be set to within an area corresponding to the above effective conveyance width A in the present embodiment as will be described below.

As illustrated in FIG. 6, in the present embodiment, a plurality of guide ribs 84*a*-84*g* are formed into a guide rib unit 94 which is mounted to the guide surface 83 as illustrated in FIG. 5. The guide surface 83 is placed between the pair of conveyance rollers 101 of the upstream side (lower side of FIG. 5) and the pair of conveyance rollers 56 of the downstream side (upper side of FIG. 5), has a width identical to the entire width of the sheet conveyance path 52, and formed into a curved surface curved into a convex shape toward the sheet conveyance path 52. Namely, the guide surface 83 has a cross section in a direction orthogonal to the sheet passing width direction formed into a convex shape projecting toward the sheet conveyance path 52. The guide surface 83 has the cross section having the same shape in any position in the sheet passing width direction. The guide surface 83 is defined with slit like through-holes (not shown) for receiving the engagement portions 99 of the below-described guide rib unit 94 (see FIG. 6).

The guide rib unit 94 includes a base plate 93 and the plurality of guide ribs 84*a*-84*g* projecting from a surface 98 of the base plate 93. The base plate 93 has a width in the sheet passing width direction narrower than the guide surface 83 and formed into a curved convex shape along the shape of the guide surface 83. At a center side of the base plate 93 of the upstream side in the sheet passing width direction, a large notch portion 96 is formed at a position corresponding to the delivery roller 28. Also, at positions of a left end side and a right end side of the downstream side of the base plate 93 corresponding to the pair of conveyance rollers 56, smaller notch portions 97 are provided therein. Further, the left end side and the right end side of the base plate 93 are provided with plate-like engagement portions 99 toward a back surface side opposite to a surface 98 side including the guide ribs 84*a*-84*g* (In FIG. 6, only the engagement portions 99 at the left end side are illustrated.).

The surface 98 of the base plate 93 is provided with six guide ribs 84*a*-84*f* uniformly spaced form each other in the sheet passing width direction. The guide ribs 84*a*-84*f* are provided in a projecting manner in the sheet conveyance direction. At the upstream side between two left end side guide ribs 84*a*, 84*b*, a shorter guide rib 84*g* is provided. The guide rib 84*g* is provided because, when the guide rib unit 94 is mounted to the guide surface 83, as illustrated in FIG. 5, the upstream side of the left end guide rib 84*a* come into interfere with the other members and thus cannot get the same length as the guide rib 84*f* at the right end, such that the guide rib 84*g* is provided here to compensate the shortage of the guide rib 84*a*.

The guide rib unit 94 having the above-described configuration can be mounted such that the engagement portions 99 are engaged with the slits of the guide surface 83 (not shown) at a center of the guide surface 83 in the sheet passing width direction as illustrated in FIG. 5. Here, all the guide ribs 84*a*-84*g* are placed within the effective conveyance width A by the two driving rollers 56*a* of the pair of conveyance rollers 56. In other words, an area positioned outside the effective conveyance width A of the guide surface 83 includes no guide rib and has a substantially curved flat surface.

Since the downstream ends of the two guide ribs 84*a*, 84*b* of the left end side are placed immediately near the left and right end surfaces of the left driven roller 56*b*, the sheet P guided by the guide ribs 84*a*, 84*b* is smoothly led to the conveyance nip portion N2. Similarly, since the downstream ends of the two guide ribs 84*e*, 84*f* at the right end side is placed immediately near the left and the right end surfaces of the right driven roller 56*b*, the sheet P guided by the guide ribs 84*e*, 84*f* can be smoothly led to the conveyance nip portion N2. In this case, the left end guide rib 84*a* and the right end guide rib 84*f* should be placed within the effective conveyance width A.

A projection height H (see FIG. 7) based on the guide surface 83 in the guide ribs 84*a*-84*g* is set to such a height that left and right end sides of the sheet P (PS), namely, portions of the sheet P positioned outside the left end side and the right end side guide ribs 84*a*, 84*f* will seldom contact the guide surface 83 regardless of the sheet passing width of the sheet P with regard to the sheet P while it is conveyed to be rubbed by the guide ribs 84*a*-84*g*.

If the projection height H is set to, for example, about 3 mm, the left end side or the right end side of the sheet P of a bad condition, for example, a thin sheet P or a recycled paper P having the maximum sheet passing width, may not substantially contact the guide surface 83. When the guide ribs 84*a*-84*g* are provided within the effective conveyance width A, for example, like the left end side guide rib 84*a* and the right end side guide rib 84*f*, it is effective to provide the guide ribs near a left side boundary and near a right side boundary within the effective conveyance width A upon conveying the sheet P having a sheet passing width larger than that of the effective conveyance width.

The sheet P can be effectively prevented from being flexed between the guide ribs 84*a*, 84*f* by providing at least more than one guide rib between the left end side guide rib 84*a* and the right end side guide rib 84*f*. The present embodiment exemplifies that four guide ribs 84*b*-84*e* are provided between the guide ribs 84*a*, 84*f* (except for the guide rib 84*g*).

As described above, when no guide rib is provided outside the effective conveyance width A of the guide surface 83 and thus the sheet P is pulled and conveyed by the pair of conveyance rollers 56 between the pair of upstream side conveyance rollers 101 and the pair of downstream side conveyance rollers 56, the sheet P is only rubbed by the guide ribs 84*a*-84*g* positioned within the effective conveyance width A but would not be rubbed by the other guide ribs. Therefore, occurrence of the conveyance friction noise can be reduced with the above-described configuration compared to conventional ones.

Since the sheet P which is conveyed while it is rubbed by the guide ribs 84*a*-84*g* is conveyed in a condition it is curved into a convex shape in accordance with the shapes of the guide ribs 84*a*-84*g*, the width direction end portion of the sheet P will not easily flex. Therefore, even such a case that there is no guide rib outside the effective conveyance width A, the sheet P can be conveyed without an trouble while it keeps the curved shape. This can be applied to a case of conveying the recycled paper of the worst condition having the maximum sheet passing width.

Here, it is preferable to form the guide ribs 84*a*-84*g* of, for example, a polyacetal resin. With the guide ribs formed of the polyacetal resin, a friction coefficient between the guide ribs 84*a*-84*g* and the sheet P can be minimized compared to the case where the guide ribs 84*a*-84*g* are formed of a general ABS resin or polystyrene, such that improvement of an abrasion resist property and reduction of the conveyance friction noise can be realized.

The present embodiment has such a configuration that the guide unit 94 including the base plate 93 and guide ribs 84*a*-84*g* formed into one piece is attached to/detached from the guide surface 83. Accordingly, the guide rib unit 94 can be attached to/detached from the guide surface 83 with ease as required. Therefore, the guide ribs 84*a*-84*g* can also be applied with ease to the other portions not only for the portion between the pair of conveyance rollers 101 and the pair of conveyance rollers 56 but for the portions having a pair of conveyance rollers at the upstream side and the downstream side respectively to convey the sheet P with tension between the pair of conveyance rollers.

Instead of the attachable/detachable guide rib unit 94, the guide ribs may be directly provided with the guide surface 83 within the effective conveyance width A. In this case, the conveyance friction noise also can be reduced.

The present embodiment exemplifies that two driving rollers 56*a* are integrally mounted to the roller shaft 95, which, however, is a mere example, and one or more than three driving rollers 56*a* may be mounted to the roller shaft 95. If the driving roller 56*a* is one, a distance between the left side exterior end surface and the right side exterior end surface of the driving roller 56*a* becomes the effective conveyance width A. Also, if the driving roller is more than three, a distance between the left side exterior end surface of the driving roller 56*a* nearest to the left end portion 95*a* of the roller shaft 95 and the right side exterior end surface of the driving roller 56*a* nearest to the right end portion 95*b* of the roller shaft 95 becomes the effective conveyance width A.

In the above description, a case where no guide rib is provided outside the effective conveyance width A of the guide surface 83 is exemplified. However, it is also possible to provide the guide ribs outside the effective conveyance width A. In this case, however, the projecting height of the guide ribs within the effective conveyance width A should be set higher than the projection height h (not shown) of the guide ribs outside the effective conveyance width A and the gap between the both projection height (H-h) should be set such that the sheet P will not contact the guide ribs outside the effective conveyance width A during the conveyance of the sheet P. With such a configuration, even in the case where the guide ribs are provided outside the effective conveyance width A, it is so configured that there are practically no guide ribs there.

SECOND EMBODIMENT

Figure 8:
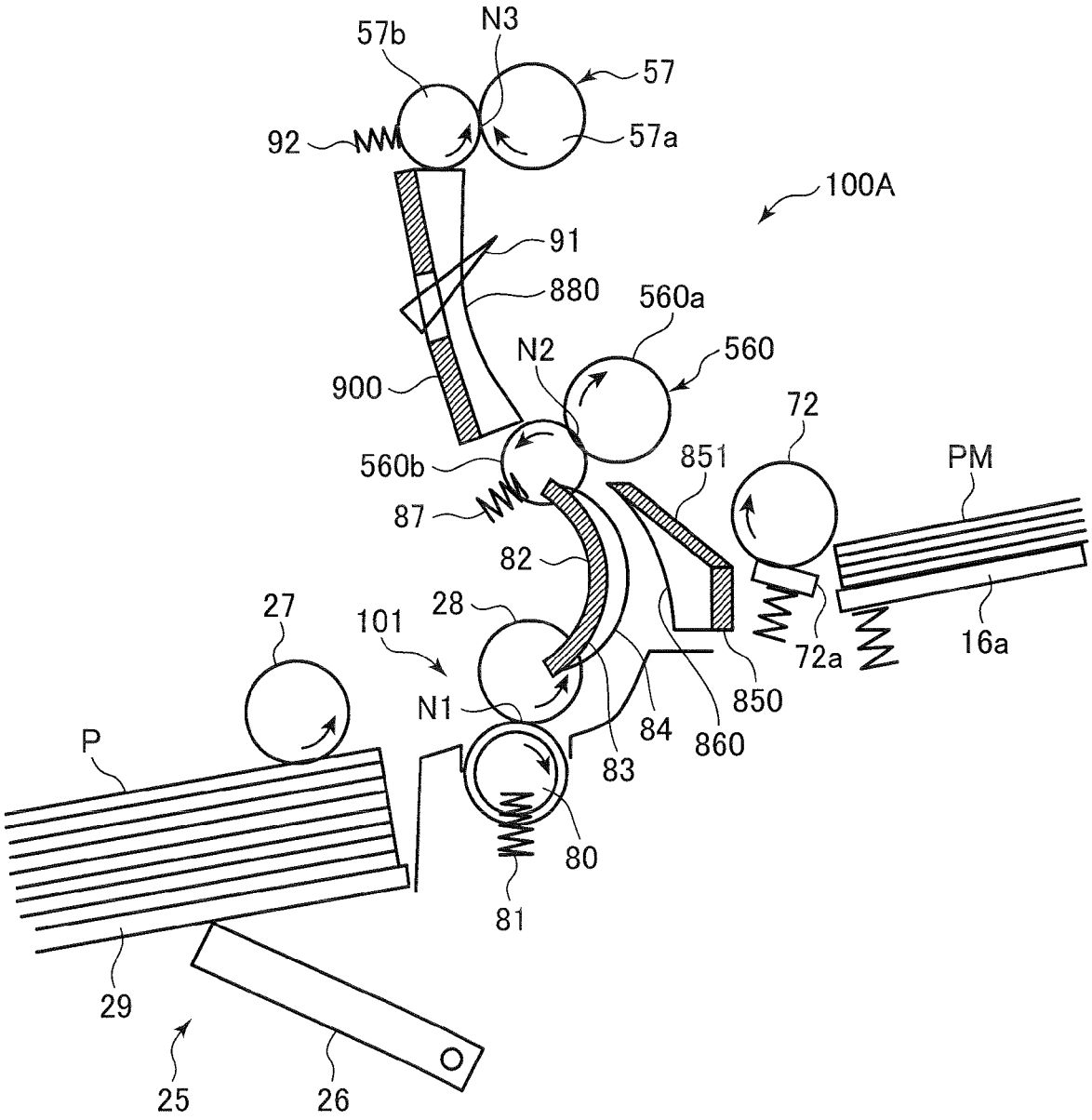
FIG. 8 illustrates an enlarged configuration of a sheet conveyance path from a manual feed unit to a pair of resist rollers according to a second embodiment.

Now, a second embodiment of the invention will be described below. The second embodiment exemplifies that the present invention is applied to a guide plate to be placed in a sheet conveyance path in a downstream side of the pair of conveyance rollers (first conveyance roller pair). FIG. 8 illustrates an enlarged configuration of a sheet conveying apparatus 100A according to the second embodiment. In FIG. 8, the same components as those in FIG. 4 have the similar reference numbers and thus the explanations thereof will be omitted or simplified here. Although it is omitted in FIG. 4, FIG. 8 illustrates the sheet conveying apparatus 100A including a sheet conveyance path for receiving the manually fed sheets PM supplied from the manual feeding tray 16 as shown in FIGS. 1 and 3.

The sheet conveying apparatus 100A, similar to the first embodiment, includes the pair of conveyance rollers 101 (delivery roller 28 and retard roller 30) for conveying the sheet P from the sheet cassette 25 and a manual feed delivery roller 72 for conveying the manually fed sheet PM from the manual feeding tray 16 as well, and further includes a pair of conveyance rollers 560 and a pair of resist rollers 57 disposed in the downstream side of these rollers. In the upstream side of the pair of conveyance rollers 560, a first guide plate 82 and a second guide plate 850 similar to those of the first embodiment are disposed. On the other hand, in the downstream side of the pair of conveyance rollers 560, a third guide plate 900 is disposed.

Figure 9:
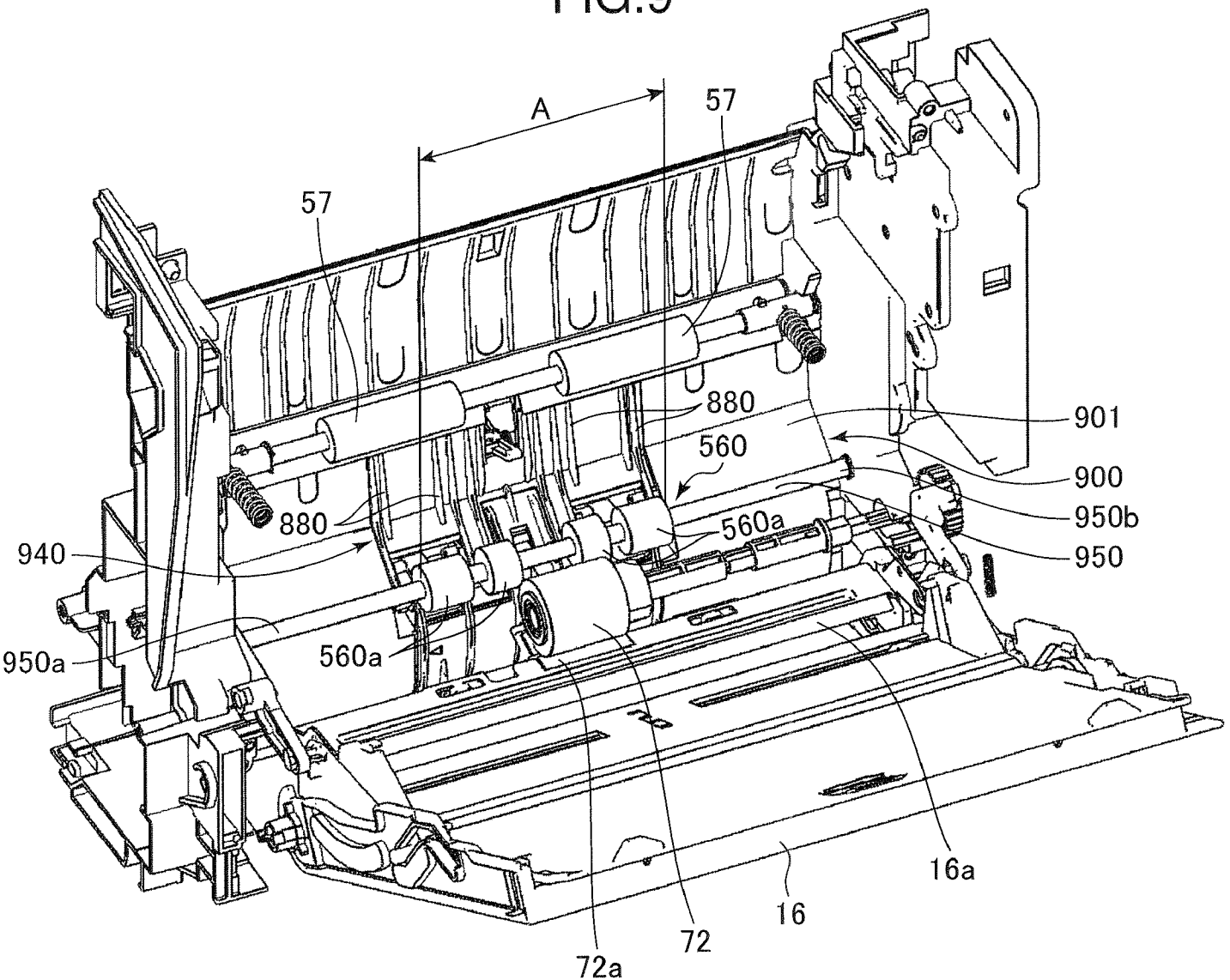
FIG. 9 is a perspective view illustrating around a guide plate exposed by opening a sheet conveyance path.
Figure 10:
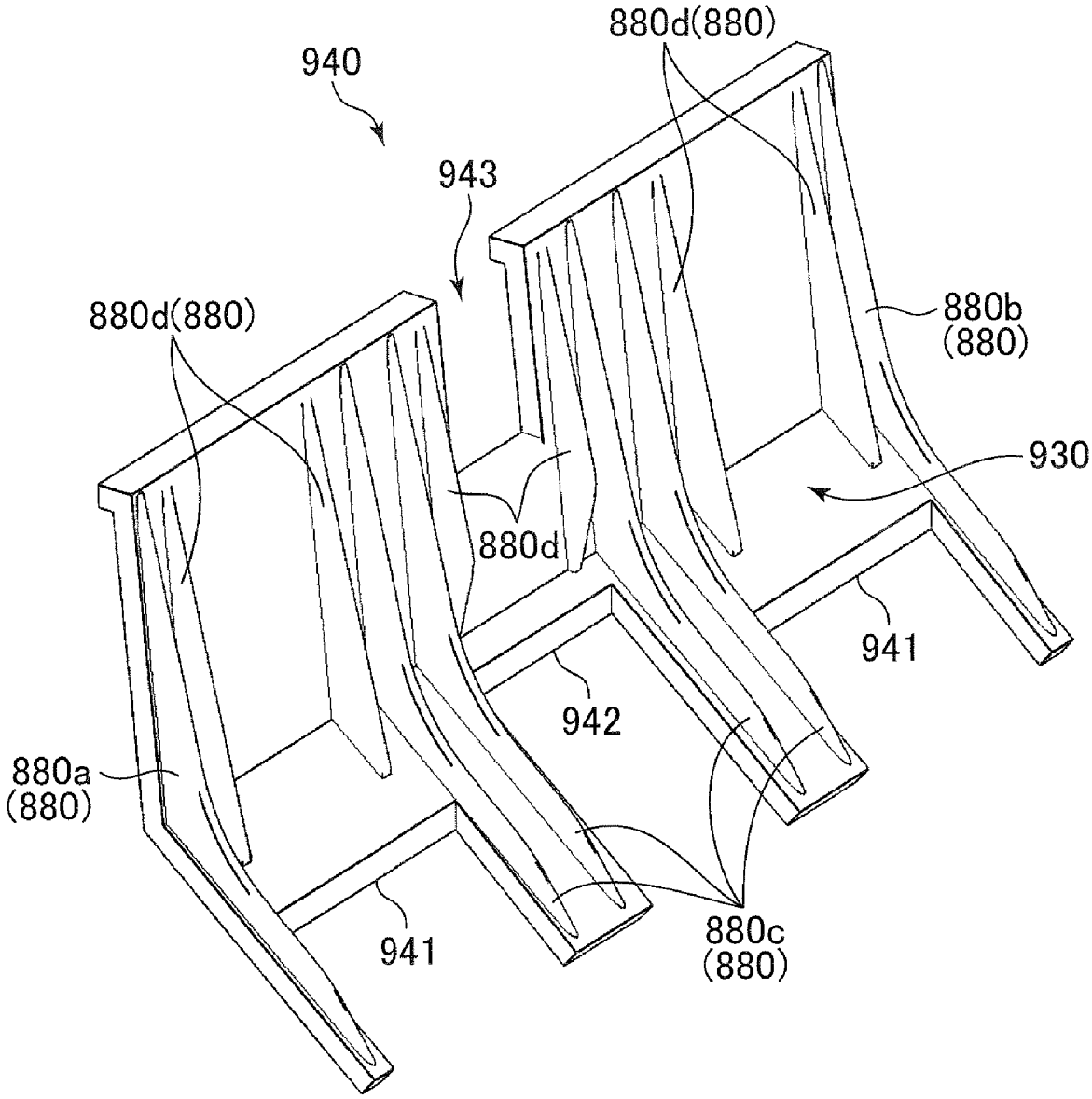
FIG. 10 is a perspective view illustrating a guide rib unit according to the second embodiment.

FIG. 9 is a perspective view illustrating a vicinity of the third guide plate 900 exposed by opening the manual feeding tray 16. FIG. 10 is a perspective view illustrating a guide rib unit 940 according to the second embodiment. In the manually feeding sheet conveyance path, a friction plate 72*a* is disposed opposite to a manual feed delivery roller 72. The friction plate 72*a* is pressurized against the manual feed delivery roller 72 and thereby forms a nip portion for picking up the manually fed sheet PM in cooperation with the manual feed delivery roller 72. In the upstream side of the manual feed delivery roller 72, there is disposed a pressure plate 16*a* which lifts the leading edge of the manually fed sheet PM stacked on the manual feeding tray 16.

A top surface of the second guide plate 850 is a guide surface 851 of the manually fed sheets PM. The manually fed sheets PM are picked up by the manual feed delivery roller 72 one by one to be guided by the guide surface 851 to the conveyance nip portion N2 of the pair of conveyance rollers 560. The pair of conveyance rollers 560 includes a driving roller 560*a* and a driven roller 560*b* similar to the first embodiment; however, FIG. 9 illustrates an example that four driving rollers 560*b* are mounted to the roller shaft 950. As described above, in this case, a distance between a left side exterior end surface of the driving roller 560*a* nearest to the left end portion 950*a* of the roller shaft 950 and a right side exterior end surface of the driving roller 560*a* nearest to the right end portion 950*b* of the roller shaft 950 becomes the effective conveyance width A.

The sheet conveyance path toward the pair of resist rollers 57 in the downstream side of the pair of conveyance rollers 560 (first conveyance roller pair) is a so-called vertical conveyance path which is curved into a U-shape. The third guide plate 900 ("guide plate" of the present embodiment) is placed in such a sheet conveyance path and has a guide surface 901 curved into a concave shape. The guide surface 901 forms an outer side wall of the conveyance path curved into the U-shape.

At a central position of the guide surface 901 in the sheet passing width direction, a guide rib unit 940 is mounted. The guide rib unit 940 includes a base plate 930 and a plurality of guide ribs 880 on a surface of the base plate 930 in a manner extending in the sheet conveyance direction. The base plate 930 is defined with notch portions 941, 942 for placing the driven rollers 560*b* and a notch potion 943 for placing the detection sensor 91.

The guide ribs 880 include longer guide ribs 880*a*, 880*b*, 880*c* provided on a portion including no notch portions 941, 942, 943 of the base plate 930 and shorter guide rib 880*d* provided on a portion including notch portions 941, 942, 943 of the base plate 930. The guide ribs 880*a*-880*d* project in parallel to each other in the sheet passing width direction. The longer guide ribs 880*a*, 880*b*, 880*c* have a boomerang shape in a side view thereof, namely, the longer guide ribs curve slightly to form a concave shape.

The guide ribs 880 are placed within the effective conveyance width A defined by four driving rollers 560*a* of the pair of conveyance rollers 560. That is, the most left side guide rib 880*a* and the most right side guide rib 880*b* are formed in such a pitch that they are placed within the effective conveyance width A. On the other hand, an area positioned outside the effective conveyance width A of the guide surface 901 does not include the guide ribs and thus is substantially a flat surface.

The projection height based on the guide surface 901 in the guide ribs 880 is set to such a height that left and right end sides of the sheet P, PM, namely, portions positioned outside the left end side and the right end side of the guide ribs 880*a*, 880*b* almost always do not contact the guide surface 901 regardless of the sheet passing width with regard to the sheet P to be conveyed while it is rubbed by the guide ribs 880 or the manually fed sheet PM.

The manually fed sheets PM stacked on the manual feeding tray 16, different from the sheets P stacked in the sheet cassette 25, include various types of sheets. The user sometimes supplies to the manual feeding tray 16 sheets of a bad condition such as curled sheets, sheets having one side printed, sheets including cutting burrs on their edges, and thick rigid sheets. When such sheets of the bad condition are conveyed by the pair of conveyance rollers 560 through the manual feed delivery roller 72, a leading end of the sheet may hit the third guide plate 900 to cause a hitting noise or a friction noise. When the guide ribs are provided on the third guide plate 900, the sheets may be buckled, or the leading edges of the sheets may hit the projecting side walls of the guide ribs to skew the sheets depending on an angle of approach of the leading edges of the sheets.

However, according to the second embodiment, the guide ribs 880 provided on the guide surface 901 of the third guide plate 900 are disposed only within the effective conveyance width A defined by the four driving rollers 560*a* of the pair of conveyance rollers 560. Therefore, the leading edge of the manually fed sheet PM (sheet P) can be prevented from hitting onto the projecting side walls of the guide ribs 880 to be skewed or buckled. The leading edge of the manually fed sheet PM only contacts the guide ribs 880 positioned within the effective conveyance width A but would not be rubbed by the other guide ribs, such that occurrence of the hitting noise or the friction noise can be reduced.

The above embodiment is applicable to the second guide plate 850. The sheet conveyance path toward the pair of conveyance rollers 560 in the downstream of the pair of conveyance rollers 101 ("first conveyance roller pair" in the present embodiment) is a so-called vertical conveyance path which curves into a U-shape. The second guide plate 850 ("guide plate" in the present embodiment) is placed in such a sheet conveyance path and includes a guide surface curved into a concave shape. The guide surface forms an exterior side wall of the conveyance path curved into the U-shape and includes a plurality of guide ribs 860 projecting in the sheet conveyance direction.

Here, the guide ribs 860 are placed only within the effective conveyance width of the delivery roller 28, such that a similar effect as produced in the above embodiment can be obtained, namely, the hitting noise caused by the leading edge of the sheet hitting the guide ribs 860 can be reduced and the sheet P can be prevented from being skewed.

INDUSTRIAL APPLICABILITY

In the above embodiment, explanation was made exemplifying a case that the present invention was applied to the sheet conveying apparatus of the image forming apparatus. The present invention, however, is not limited to the above embodiments but can be widely applied to a sheet conveying apparatus in which a guide plate is placed between the pair of upstream side conveyance rollers and the pair of downstream side conveyance rollers and a sheet-like object is guided while it is being pulled between both pairs of rollers to convey the sheet-like object or the sheet conveying apparatus in which the curved guide plate is placed in the downstream side of the pair of conveyance rollers.

The above-described specific embodiments mainly encompass the inventions having the following configurations.

A sheet conveying apparatus for conveying a sheet according to one aspect of the present invention comprises: a sheet conveyance path designed including a nonlinear portion; a first conveyance roller pair having a conveyance width which are placed at predetermined positions of the sheet conveyance path and capable of nipping and conveying a sheet having the minimum sheet passing width among sheets to be passed through the sheet conveying apparatus; a guide plate, having a curved guide surface, placed at a downstream side or an upstream side in a sheet conveyance direction of the first conveyance roller pair; and a plurality of guide ribs which are extended on the guide surface in the sheet conveyance direction so as to be disposed in an area corresponding to a conveyance width of the first conveyance roller pair in a sheet passing width direction of the sheet.

With such a configuration, since the guide ribs are disposed on the area corresponding to the conveyance width of the first conveyance roller pair, the conveyance friction noise can be reduced.

In the above-described configuration, the first conveyance roller pair includes a roller body in which one first roller or a plurality of first rollers is/are mounted to one roller shaft and a second roller disposed corresponding to the one first roller or the plurality of first rollers in which, assuming that one of the end portions of the roller shaft in the shaft direction is a first end portion and the other end portion is a second end portion, the conveyance width can be set to a width of a distance between a portion nearest to the first end portion side and a portion nearest to the second end portion side among the first rollers which contact the sheet having the minimum sheet passing width upon conveying the sheet having the minimum sheet passing width.

It is preferable for such a configuration to further include a driving source for applying the roller shaft a rotational driving force around the shaft and the second roller rotates following a rotation of the roller body. With such a configuration, the roller body is formed into a driving roller and the second roller is formed into a driven roller to finally form a pair of conveyance rollers.

In the above configuration, it is a preferable embodiment that the sheet conveyance path upstream the first conveyance roller pair is a conveyance path curved into a U-shape; the guide plate is disposed in a downstream side of the first conveyance roller pair; the guide plate has a guide surface curved into a convex shape; and the guide surface forms an interior side wall of the conveyance path curved into the U-shape.

Also, it is a preferable embodiment that the sheet conveyance path downstream the first conveyance roller pair is a conveyance path curved into a U-shape; the guide plate is disposed in a downstream side of the first conveyance roller pair; the guide plate has a guide surface curved into a concave shape; and the guide surface is formed into an exterior side wall of the conveyance path curved into the U-shape. According to the configuration, the sheet is prevented from being skewed when a curled sheet or a rigid sheet hits side walls of the guide ribs and occurrence of the hitting noise or the friction noise can be reduced.

It is preferable that the above-described configuration further includes a second conveyance roller pair which is disposed at a predetermined position of the sheet conveyance path and disposed in an upstream side of the first conveyance roller pair, and a guide plate which is disposed between the first conveyance roller pair and the second conveyance roller pair and has a guide surface curved into a convex shape. With such a configuration, when a sheet is conveyed such that it is guided by the guide plate while the sheet is pulled between the first conveyance roller pair and the second conveyance roller pair, occurrence of the friction noise can be reduced.

In the above-described configuration, the guide plate may have a guide surface curved into a concave shape.

In the above configuration, it is preferable that the guide ribs positioned within the conveyance width are attachable to/detachable from the guide surface. With such a configuration, the guide ribs can be mounted to the guide surface with ease as required. In other words, the guide ribs can be mounted to the conventional guide member with ease.

In the above-described configuration, it is preferable that the guide surface of the guide plate is substantially flat except for projecting portions of the guide ribs within the conveyance width. With such a configuration, occurrence of the friction noise can further be reduced.

It is preferable that, in the above configuration, the guide ribs positioned within the conveyance width are formed of a member excellent in slidability than that of the guide plate. With such a configuration, since the friction coefficient between the guide ribs and the sheet can be minimized, the conveyance friction noise can be further minimized accordingly.

An image forming apparatus according to another aspect of the present invention comprises: an image forming unit configured to form an image onto a sheet; and a sheet conveyance unit configured to convey a sheet having a predetermined sheet passing width through the image forming unit; wherein the sheet conveyance unit includes: a sheet conveyance path designed to include nonlinear portions; a first conveyance roller pair which is disposed at predetermined positions of the sheet conveyance path and has a conveyance width capable of nipping and conveying a sheet having the minimum sheet passing width among the sheets to be passed through the sheet conveying apparatus; a guide plate which is disposed in a downstream side or an upstream side of the first conveyance roller pair in the sheet conveyance direction and has a curved guide surface; and a plurality of guide ribs which are extended on the guide surface in the sheet conveyance direction and disposed in the sheet passing width direction of the sheets on an area corresponding to the conveyance width of the first conveyance roller pair.

According to the above configuration, an image forming apparatus of less conveyance friction noise of the sheets, less hitting noise of the sheets, and less sheet skew can be provided.

The above configuration may further include a second conveyance roller pair which is disposed at predetermined positions of the sheet conveyance path and disposed in an upstream side of the first conveyance roller pair, in which the guide plate is disposed between the first conveyance roller pair and the second conveyance roller pair and includes a guide surface curved into a convex shape.

In this case, such a configuration may further include a sheet cassette for storing a plurality of sheets and a pair of resist rollers disposed in a downstream side of the first conveyance roller pair and an upstream side of the image forming unit in the sheet conveyance path; the second conveyance roller pair serves as a pair of sheet feeding rollers for sending one of the sheets from the sheet cassette to the downstream side of the sheet conveyance path; the first conveyance roller pair serves as an intermediate conveyance roller pair for sending the sheet to the pair of resist rollers; the sheet conveyance path between the pair of sheet feeding rollers and the intermediate conveyance roller pair is a conveyance path curved into a U-shape; and the guide surface forms an interior side wall of the conveyance path curved into the U-shape.

According to such a configuration, the friction noise can be reduced when the sheet is conveyed while it is nipped between the pair of sheet feeding rollers and the intermediate conveyance roller pair and while the sheet is rubbed against the guide surface curved into a convex shape in the image forming apparatus having a sheet conveyance path curved into the U-shape between the pair of sheet feeding rollers and the intermediate conveyance roller pair.

The above configuration may further include a manual feed unit enabling a manual sheet supply and a pair of resist rollers disposed in the downstream side of the first conveyance roller pair and the upstream side of the image forming apparatus in the sheet conveyance path; in which the first conveyance roller pair serves as the intermediate conveyance roller pair for sending the sheet toward the pair of resist rollers; the sheet conveyance path between the intermediate roller pair and the pair of resist rollers is a conveyance path curved into a U-shape; the guide plate has a guide surface curved into a concave shape; the guide surface forms an external side wall of the conveyance path curved into the U-shape.

With such a configuration, the friction noise and the hitting noise can be reduced and the sheet is prevented from being skewed even in the case where the leading edge of the sheet hits the guiding surface curved into the concave shape, since a manually fed sheet from the manual feed unit is nipped between the intermediate conveyance roller pair in the image forming apparatus including the sheet conveyance path curved into the U-shape between the intermediate conveyance roller pair and the pair of resist rollers.

This application is based on patent application No. 2007-105668 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An image forming apparatus comprising:

an image forming unit configured to form an image on a sheet; and a sheet conveyance unit configured to convey the sheet having a predetermined sheet passing width through the image forming unit;

wherein the sheet conveyance unit includes:

a sheet conveyance path designed so as to include nonlinear portions;

a first conveyance roller pair which is provided at predetermined positions of the sheet conveyance path and which has a conveyance width therebetween capable of nipping and conveying a sheet having the minimum size sheet passing width among the sheets to be passed through the sheet conveying apparatus;

a pair of resist rollers disposed in a downstream side of the first conveyance roller pair and in an upstream side of the image forming unit in the sheet conveyance path;

a second conveyance roller pair which is provided in an upstream side of the first conveyance roller pair in the sheet conveyance path;

a first guide plate which is placed between the first conveyance roller pair and the second conveyance roller pair, and has a first curved guide surface;

a second guide plate which is placed between the first conveyance roller pair and the pair of resist rollers, and has a second curved guide surface; and a plurality of guide ribs which are extended on at least one of the first guide surface and the second guide surface in a sheet conveyance direction and are provided in a sheet passing width direction of the sheet in a region corresponding to the conveyance width of the first conveyance roller pair; wherein at least one of a first section of the sheet conveyance path between the second conveyance roller pair and the first conveyance roller pair, and a second section of the sheet conveyance path between the first conveyance roller pair and the pair of resist rollers is curved into a U-shape, and at least one of the first guide plate and the second guide plate forms one side wall of the section of the conveyance path curved into the U-shape.

2. The image forming apparatus according to claim 1, wherein the first conveyance roller pair includes:

a roller body including one or more first rollers mounted to a roller shaft; and a second roller disposed corresponding to one or more first rollers;

wherein the conveyance width, when one end portion of the roller shaft in a shaft direction is referred to as a first end portion and the other end portion thereof is referred to as a second end portion, is a width between a portion nearest to the first end portion side and a portion nearest to the second end portion side among the first rollers brought into contact with a sheet having the minimum sheet passing width upon conveying the sheet having the minimum sheet passing width.

3. The image forming apparatus according to claim 2 further comprising:

a driving source which applies a rotational driving force to the roller shaft around the shaft;

wherein the second roller rotates following a rotation of the roller body.

4. The image forming apparatus according to claim 1 further comprising:

a sheet cassette for stacking a plurality of sheets;

wherein the second conveyance roller pair serve as a pair of sheet supply rollers for sending one of the sheets from the sheet cassette to the downstream side of the sheet conveyance path;

wherein the first conveyance roller pair serves as an intermediate conveyance roller pair for sending the sheet toward the pair of resist rollers;

wherein the first section of the sheet conveyance path is curved into a U-shape; and wherein the first guide plate has a first guide surface curved into a convex shape, the first guide surface forming an interior side wall of the section of the conveyance path curved into the U-shape.

5. The image forming apparatus according to claim 1 further comprising:

a manual feed unit enabling a manual sheet supply; and wherein the first conveyance roller pair serve as the intermediate conveyance roller pair for sending the sheet from the manual feed unit toward the pair of resist rollers;

wherein the second section of the sheet conveyance path is curved into a U-shape; and the second guide plate has a second guide surface curved into a concave shape, the second guide surface forming an exterior side wall of the section of the conveyance path curved into the U-shape.

6. An image forming apparatus comprising:

an image forming unit configured to form an image on a sheet; and a sheet conveyance unit configured to convey the sheet having a predetermined sheet passing width through the image forming unit;

wherein the sheet conveyance unit includes:

a sheet conveyance path designed so as to include nonlinear portions;

a first conveyance roller pair which is provided at predetermined positions of the sheet conveyance path and which has a conveyance width therebetween capable of nipping and conveying a sheet having the minimum size sheet passing width among the sheets to be passed through the sheet conveying apparatus;

a pair of resist rollers disposed in a downstream side of the first conveyance roller pair and in an upstream side of the image forming unit in the sheet conveyance path;

a second conveyance roller pair which is disposed in an upstream side of the first conveyance roller pair in the sheet conveyance path;

a guide plate which is placed in an upstream side of the first conveyance roller pair in a sheet conveyance direction and having a curved guide surface; and a plurality of guide ribs which are extended on the guide surface in the sheet conveyance direction and are provided in a sheet passing width direction of the sheet in a region corresponding to the conveyance width of the first conveyance roller pair; wherein the second conveyance roller pair serves as a pair of sheet supply rollers for sending the sheet to the downstream side of the sheet conveyance path;

the first conveyance roller pair serves as an intermediate conveyance roller pair for sending the sheet toward the pair of resist rollers;

a section of the sheet conveyance path between the pair of sheet supply rollers and the intermediate conveyance roller pair is curved into a U-shape; and the guide plate has a guide surface curved into a convex shape, the guide surface forming an interior side wall of the section of the conveyance path curved into the U-shape.

7. The image forming apparatus according to claim 6, further comprising:

a sheet cassette for stacking a plurality of sheets; wherein the pair of sheet supply rollers sends one of the sheets from the sheet cassette to the downstream side of the sheet conveyance path.

8. An image forming apparatus comprising:

an image forming unit configured to form an image on a sheet; and a sheet conveyance unit configured to convey the sheet having a predetermined sheet passing width through the image forming unit;

wherein the sheet conveyance unit includes:

a sheet conveyance path designed so as to include nonlinear portions;

a first conveyance roller pair which is provided at predetermined positions of the sheet conveyance path and which has a conveyance width therebetween capable of nipping and conveying a sheet having the minimum size sheet passing width among the sheets to be passed through the sheet conveying apparatus;

a pair of resist rollers disposed in a downstream side of the first conveyance roller pair and in an upstream side of the image forming unit in the sheet conveyance path;

a guide plate which is placed in a downstream side of the first conveyance roller pair in a sheet conveyance direction and has a curved guide surface; and a plurality of guide ribs which are extended on the guide surface in the sheet conveyance direction and are provided in a sheet passing width direction of the sheet in a region corresponding to the conveyance width of the first conveyance roller pair; wherein the first conveyance roller pair serves as an intermediate conveyance roller pair for sending the sheet toward the pair of resist rollers;

a section of the sheet conveyance path between the intermediate conveyance roller pair and the pair of resist rollers is curved into a U-shape; and the guide plate has a guide surface curved into a concave shape, the guide surface forming an exterior side wall of the section of the conveyance path curved into the U-shape.

9. The image forming apparatus according to claim 8, further comprising:

a manual feed unit enabling a manual sheet supply; wherein the intermediate conveyance roller sends the sheet from the manual feed unit toward the pair of resist rollers.

* * * * *